US008056642B2

(12) United States Patent
Kriesels et al.

(10) Patent No.: US 8,056,642 B2
(45) Date of Patent: Nov. 15, 2011

(54) METHOD OF RADIALLY EXPANDING A TUBULAR ELEMENT

(75) Inventors: Petrus Cornelis Kriesels, Rijswijk (NL); Robert Donald Mack, New London, NH (US); Mark Michael Shuster, Voorburg (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 12/768,404

(22) Filed: Apr. 27, 2010

(65) Prior Publication Data

US 2010/0331959 A1 Dec. 30, 2010

(51) Int. Cl.
*E21B 19/00* (2006.01)

(52) U.S. Cl. ..... 166/384; 405/150.1

(58) Field of Classification Search ..... 166/380, 166/384, 55, 242.2; 405/150.1; 138/98; 175/226

See application file for complete search history.

(56) References Cited

U.S. PATENT DOCUMENTS

| | | | | |
|---|---|---|---|---|
| 2,927,775 A | | 3/1960 | Hildebrandt | 255/72 |
| 4,602,974 A | | 7/1986 | Wood et al. | 156/287 |
| 5,454,401 A | * | 10/1995 | Kamiyama et al. | 138/98 |
| 5,634,743 A | * | 6/1997 | Chandler | 405/150.1 |
| 5,680,885 A | * | 10/1997 | Catallo | 138/98 |
| 5,853,049 A | | 12/1998 | Keller | 166/380 |
| 5,971,031 A | * | 10/1999 | Kamiyama et al. | 138/98 |
| 6,006,787 A | * | 12/1999 | Kamiyama et al. | 138/98 |
| 7,096,890 B2 | * | 8/2006 | Woolstencroft et al. | 138/98 |
| 2006/0130922 A1 | | 6/2006 | Kamiyama et al. | 138/98 |

FOREIGN PATENT DOCUMENTS

| | | |
|---|---|---|
| EP | 0044706 | 1/1982 |
| WO | WO9947340 | 9/1999 |
| WO | WO03036025 | 5/2003 |

* cited by examiner

*Primary Examiner* — Daniel P Stephenson

(57) ABSTRACT

The invention relates to a method of radially expanding a tubular element extending into a wellbore formed in an earth formation, the tubular element including a first layer and a second layer extending around the first layer, said layers being separable from each other. The method comprises inducing each layer to bend radially outward and in an axially reverse direction so as to form an expanded tubular section extending around a remaining tubular section of the tubular element, wherein each layer has a respective bending zone in which the bending occurs, and increasing the length of the expanded tubular section by inducing the respective bending zones of the layers to move in an axial direction relative to the remaining tubular section. The layers in the respective bending zones are separate from each other so as to define an axial space between the layers.

19 Claims, 2 Drawing Sheets

METHOD OF RADIALLY EXPANDING A TUBULAR ELEMENT

RELATED CASES

The present application claims priority to PCT Application EP2008/064512, filed 27 Oct. 2008, which in turn claims priority from European Application EP07119460.9, filed 29 Oct. 2007.

FIELD OF THE INVENTION

The present invention relates to a method of radially expanding a tubular element in a wellbore.

BACKGROUND OF THE INVENTION

The technology of radially expanding tubular elements in wellbores is increasingly applied in the industry of oil and gas production from subterranean formations. Wellbores are generally provided with one or more casings or liners to provide stability to the wellbore wall, and/or to provide zonal isolation between different earth formation layers. The terms "casing" and "liner" refer to tubular elements for supporting and stabilising the wellbore wall, whereby it is generally understood that a casing extends from surface into the wellbore and that a liner extends from a downhole location further into the wellbore. However, in the present context, the terms "casing" and "liner" are used interchangeably and without such intended distinction.

In conventional wellbore construction, several casings are set at different depth intervals, and in a nested arrangement, whereby each subsequent casing is lowered through the previous casing and therefore has a smaller diameter than the previous casing. As a result, the cross-sectional wellbore size that is available for oil and gas production, decreases with depth. To alleviate this drawback, it has become general practice to radially expand one or more tubular elements at the desired depth in the wellbore, for example to form an expanded casing, expanded liner, or a clad against an existing casing or liner. Also, it has been proposed to radially expand each subsequent casing to substantially the same diameter as the previous casing to form a monobore wellbore. It is thus achieved that the available diameter of the wellbore remains substantially constant along (a portion of) its depth as opposed to the conventional nested arrangement.

EP 1438483 B1 discloses a method of radially expanding a tubular element in a wellbore whereby the tubular element, in unexpanded state, is initially attached to a drill string during drilling of a new wellbore section. Thereafter the tubular element is radially expanded and released from the drill string.

To expand such wellbore tubular element, generally a conical expander is used with a largest outer diameter substantially equal to the required tubular diameter after expansion. The expander is pumped, pushed or pulled through the tubular element. Such method can lead to high friction forces that need to be overcome, between the expander and the inner surface of the tubular element. Also, there is a risk that the expander becomes stuck in the tubular element.

EP 0044706 A2 discloses a method of radially expanding a flexible tube of woven material or cloth by eversion thereof in a wellbore, to separate drilling fluid pumped into the wellbore from slurry cuttings flowing towards the surface.

Although in some applications the known expansion techniques have indicated promising results, there is a need for an improved method of radially expanding a tubular element.

SUMMARY OF THE INVENTION

In accordance with the invention there is provided a method of radially expanding a tubular element extending into a wellbore formed in an earth formation, the tubular element including a first layer and a second layer extending around the first layer, said layers being separable from each other, the method comprising: inducing each layer to bend radially outward and in axially reverse direction so as to form an expanded tubular section extending around a remaining tubular section of the tubular element, wherein each layer has a respective bending zone in which the bending occurs; and increasing the length of the expanded tubular section by inducing the respective bending zones of the layers to move in an axial direction relative to the remaining tubular section; wherein the layers in the respective bending zones are separate from each other so as to define an axial space between the layers.

Thus, the tubular element is effectively turned inside out during the bending process. The bending zone of a respective layer defines the location where the bending process takes place. By inducing the bending zone of each layer to move in an axial direction along the tubular element it is achieved that the tubular element is progressively expanded without the need for an expander that is pushed, pulled or pumped through the tubular element.

Furthermore, with the method of the invention it is achieved that the required force for inverting the tubular element, is significantly lower than the force necessary to invert a tubular element having a wall of similar wall thickness, made of a single wall layer rather than separate layers. Nevertheless, the burst strength and collapse strength of the tubular element inverted with the method of the invention, are comparable to those of the tubular element having a wall made of a single layer.

The first and second layers are suitably kept together, in the remaining tubular section, by virtue of a tensile hoop stress in the second layer and a compressive hoop stress in the first layer.

It is preferred that at least one of said layers includes a material that is plastically deformed in the respective bending zone during the bending process so that the expanded tubular section retains an expanded shape as a result of said plastic deformation. In this manner it is achieved that the expanded tubular section retains its shape due to plastic deformation, i.e. permanent deformation, of the wall. Thus, the expanded tubular section maintains its expanded shape, without the need for an external force or pressure to maintain its expanded shape. If, for example, the expanded tubular section has been expanded against the wellbore wall as a result of said bending of the wall, no external radial force or pressure needs to be exerted to the expanded tubular section to keep it against the wellbore wall. Suitably the wall of the tubular element is made of a metal such as steel or any other ductile metal capable of being plastically deformed by eversion of the tubular element. The expanded tubular section then has adequate collapse resistance, for example in the order of 100-150 bars. If the tubular element extends vertically in the wellbore, the weight of the remaining tubular section can be utilised to contribute to the force needed to induce downward movement of the bending zone.

Suitably the bending zone is induced to move in an axial direction relative to the remaining tubular section by inducing the remaining tubular section to move in an axial direction relative to the expanded tubular section. For example, the expanded tubular section is held stationary while the remaining tubular section is moved in axial direction through the expanded tubular section to induce said bending of the wall.

In order to induce movement of the remaining tubular section, preferably the remaining tubular section is subjected to an axially compressive force acting to induce the movement. The axially compressive force preferably at least partly results from the weight of the remaining tubular section. If necessary the weight can be supplemented by an external, downward, force applied to the remaining tubular section to induce said movement. As the length, and hence the weight, of the remaining tubular section increases, an upward force may need to be applied to the remaining tubular section to prevent uncontrolled bending or buckling in the bending zone.

If the bending zone is located at a lower end of the tubular element, whereby the remaining tubular section is axially shortened at a lower end thereof due to the movement of the bending zone, it is preferred that the remaining tubular section is axially extended at an upper end thereof in correspondence with said the shortening at the lower end thereof. The remaining tubular section gradually shortens at its lower end due to continued reverse bending of the wall. Therefore, by extending the remaining tubular section at its upper end to compensate for shortening at its lower end, the process of reverse bending the wall can be continued until a desired length of the expanded tubular section is reached. The remaining tubular section can be extended at its upper end, for example, by connecting a tubular portion to said upper end in any suitable manner such as by welding. Alternatively, the remaining tubular section can be provided in the form of a coiled tubing which is unreeled from a reel and gradually inserted into the wellbore. Thus, the coiled tubing is extended at its upper end by unreeling from the reel.

As a result of forming the expanded tubular section around the remaining tubular section, an annular space is formed between the unexpanded and expanded tubular sections. To increase the collapse resistance of the expanded tubular section, a pressurized fluid can be inserted into the annular space. The fluid pressure can result solely from the weight of the fluid column in the annular space, or in addition also from an external pressure applied to the fluid column.

The expansion process is suitably initiated by bending the wall of the tubular element at a lower end portion thereof.

Advantageously the wellbore is being drilled with a drill string extending through the unexpanded tubular section. In such application the unexpanded tubular section and the drill string preferably are lowered simultaneously through the wellbore during drilling with the drill string.

Optionally the bending zone can be heated to promote bending of the tubular wall.

To reduce any buckling tendency of the unexpanded tubular section during the expansion process, the remaining tubular section advantageously is centralised within the expanded section by any suitable centralising means.

BRIEF DESCRIPTION OF THE DRAWINGS

The invention will be described hereinafter in more detail and by way of example, with reference to the accompanying drawings in which.

In the Figures and the description like reference numerals relate to like components.

DETAILED DESCRIPTION OF THE PREFERRED EMBODIMENTS

Figure 1:
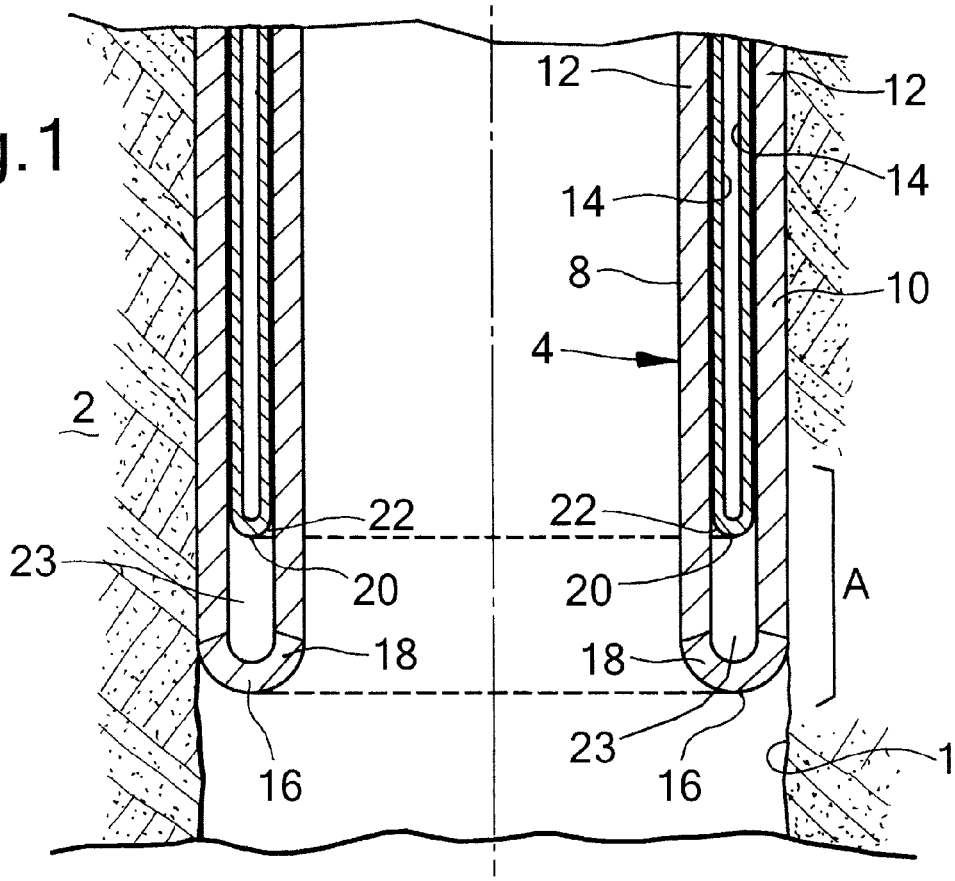
FIG. 1 schematically shows a first embodiment of a system for use with the method of the invention.
Figure 2:
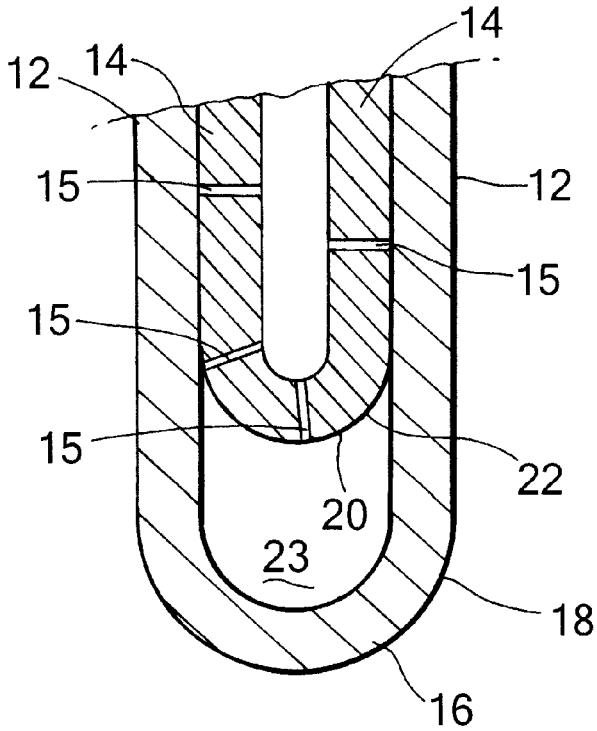
FIG. 2 schematically shows detail A of FIG. 1.

Referring to FIGS. 1 and 2 there is shown a system comprising a wellbore 1 extending into an earth formation 2, and a tubular element in the form of liner 4 extending downwardly into the wellbore 1. The liner 4 has been partially radially expanded by eversion of the wall of the liner whereby a radially expanded tubular section 10 of the liner 4 has been formed. A remaining tubular section 8 of the liner 4 extends concentrically within the expanded tubular section 10. The wall of the liner 4 includes a first layer 12 and a second layer 14, both of steel, whereby the second layer 14 extends around the first layer 12 at the remaining liner section 8. Thus, as a result of the eversion process, the second layer 14 extends inside the first layer 12 at the expanded liner section 10.

The first and second layers 12, 14 are separable from each other. The layers 12, 14 can be held together, for example, by a suitable pre-stress in circumferential direction. That is to say, at the remaining liner section 8, the first layer 12 is subjected to a compressive pre-stress in a circumferential direction, and the second layer 14 is subjected to a tensile pre-stress in a circumferential direction. After eversion of the liner wall, the first layer 12 is subjected to a tensile stress in a circumferential direction, and the second layer 14 to a compressive stress in a circumferential direction.

The second layer 14 is provided with a plurality of regularly spaced through-openings 15 (FIG. 2).

The first layer 12 is, due to eversion at its lower end, bent radially outward and in an axially reverse (i.e. upward) direction so as to form a U-shaped lower section 16 of first layer 12 interconnecting respective sections of first layer 12 at the unexpanded liner section 8 and the expanded liner section 10. The U-shaped lower section 16 of the first layer 12 defines a bending zone 18 of the first layer 12.

The second layer 14 is, due to eversion at its lower end, bent radially outward and in an axially reverse (i.e. upward) direction so as to form a U-shaped lower section 20 of second layer 14 interconnecting respective sections of second layer 14 at the unexpanded liner section 8 and the expanded liner section 10. The U-shaped lower section 20 of the second layer 14 defines a bending zone 22 of the second layer 14.

Furthermore, the first and second layers 12, 14 are separate from each other in the respective bending zones 18, 22 so as to form an axial space 23 between the U-shaped lower section 16 of the first layer 12 and U-shaped lower section 20 of the first layer 14.

The expanded liner section 10 is axially fixed to the wellbore wall 12 by virtue of frictional forces between the expanded liner section 10 and the wellbore wall 12 resulting from the expansion process. Alternatively, or additionally, the expanded liner section 10 can be anchored to the wellbore wall 12 by any suitable anchoring means (not shown).

Figure 3:
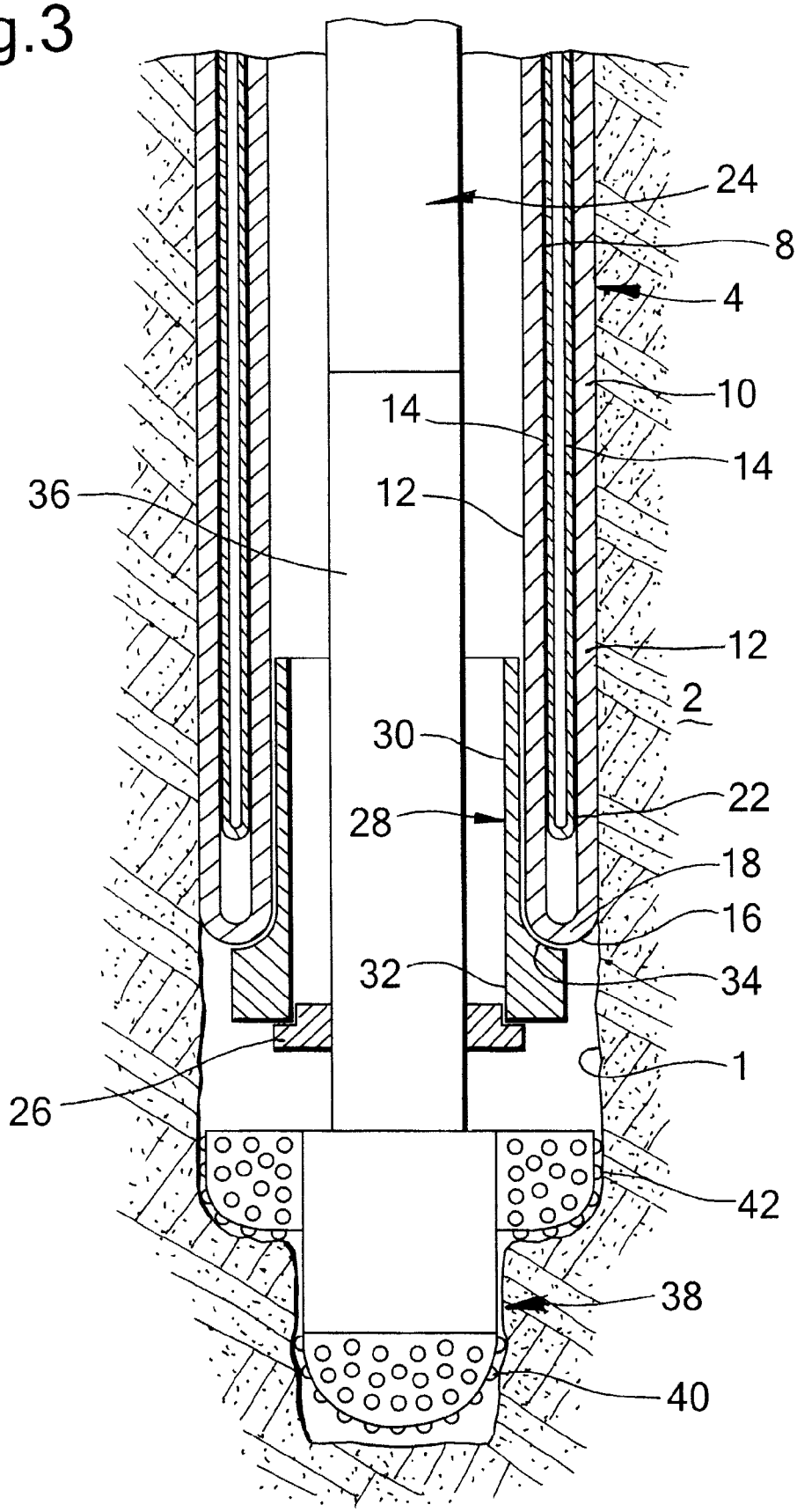
FIG. 3 schematically shows a second embodiment of a system for use with the method of the invention.

Referring further to FIG. 3, there is shown the wellbore 1 and liner 4 of FIG. 1, modified in that a drill string 24 extends from surface through the unexpanded liner section 8 to the bottom of the wellbore 1. The drill string 24 is provided with a support ring 26 supporting a tubular guide member 28 having an upper part 30 extending into the unexpanded liner section 8 and a lower part 32 extending below the U-shaped lower section 16 of the first layer 12. The lower part 32 of guide member 28 has an external, concave, guide surface 34 extending radially outward and being arranged to guide, and support, the U-shaped lower section 16.

The drill string 24 has a bottom hole assembly including a downhole motor 36 and a drill bit 38 driven by the downhole motor 36. The drill bit 38 comprises a pilot bit 40 with gauge diameter slightly smaller than the internal diameter of the guide member 28, and a reamer section 42 with gauge diameter adapted to drill the wellbore 1 to its nominal diameter. Both the reamer section 42 and the support ring 26 are radially retractable to an outer diameter allowing these devices to pass through the guide member 28 and the unexpanded liner section 8, so that the drill string 24 can be retrieved through the unexpanded liner section 8.

During normal operation of the first embodiment (FIGS. 1 and 2), the lower end portions of the first and second layers 12, 14 of the yet unexpanded liner 4 are bent radially outward and in an axially reverse direction in any suitable manner, so that the U-shaped lower sections 16, 20 are initially formed. It should thereby be ensured that the U-shaped lower section 16 of the first layer 12 extends a selected distance below the U-shaped lower section 20 of the second layer 14 to form the axial space 23 there between.

After an initial portion of the liner 4 has been everted, the expanded liner section 10 can be anchored to the wellbore wall by any suitable means. Depending on geometry and/or material properties of the liner 4, such anchoring also can occur automatically due to frictional forces between the expanded liner section 10 and the wellbore wall.

A downward force F of sufficient magnitude is then applied to the unexpanded liner section 8 in order to move the unexpanded liner section 8 gradually downward. As a result, the first and second layers 12, 14 at the unexpanded liner section 8 progressively bend in a reverse direction, thereby progressively transforming the unexpanded liner section 8 into the expanded liner section 10. During the eversion process, the bending zones 18, 22 of the respective layers 12, 14 move in a downward direction at approximately half the speed of the unexpanded section 8. The axial space 23 remains approximately constant during the eversion process. However it should be noted that the bending zone 22 of the second layer 14 may move slightly faster in the downward direction than the bending zone 18 of the first layer 12.

Such difference in speed of movement of the respective bending zones 18, 22 may occur due to the first layer 12 being subjected to a larger radial expansion than the second layer 14, which may lead to a larger axial contraction of the first layer than axial contraction of the second layer 14. In such case, the axial space 23 should be properly selected to have a minimum magnitude at the start of the eversion process in order to ensure that the bending zones 18, 20 remain axially spaced from each other during the entire eversion process.

The through-openings 15 in the second layer 14 allow free transfer of fluid between the axial space 23 and the annular space between the unexpanded and expanded liner sections 8, 10, so that possible volume changes of axial space 23 do not lead to undesired pressure changes in axial space 23.

Thus, during the eversion process, the second layer 14 becomes separate from the first layer 12 upon entering the bending zone 22. Subsequently, upon leaving the bending zone 22, the second layer becomes clad again to the first layer 12.

If desired, the diameter and/or wall thickness of the liner 4 can be selected such that the expanded liner section 10 becomes firmly compressed against the wellbore wall as a result of the expansion process so as to seal against the wellbore wall and/or to stabilize the wellbore wall. Since the length, and hence the weight, of the unexpanded section 8 gradually increases, the magnitude of downward force F can be decreased gradually in correspondence with the increased weight of section 8.

Normal operation of the second embodiment (FIG. 3) is substantially similar to normal operation of the first embodiment (FIGS. 1 and 2) with regard to eversion of the liner 4. In addition, the following features apply to normal operation of the second embodiment. The downhole motor 36 is operated to rotate the drill bit 38 so as to deepen the wellbore 1 by further drilling. The drill string 24 and the unexpanded liner section 8 thereby move simultaneously deeper into the wellbore 1 as drilling proceeds. As drilling proceeds, pipe sections are added at the top of unexpanded liner section 8 in correspondence with its lowering into the wellbore, as is normal practice for installing casings or liners into wellbores.

The wall of U-shaped lower section 16 of the first layer 12 is supported and guided by the guide surface 34 of guide member 28 so as to promote bending of the first layer 12 in the bending zone 18.

Initially the downward force F needs to be applied to the unexpanded liner section 8 to induce lowering thereof simultaneously with lowering of the drill string 24. As the length, and hence the weight, of the unexpanded liner section 8 increases, the magnitude of downward force F can be gradually decreased, and eventually may be replaced by an upward force to prevent buckling of the unexpanded liner section 8. Such upward force can be exerted to the drill string 24 at surface, and from the drill string transmitted to the unexpanded liner section 8 via the support ring 26 and guide member 28. The weight of the unexpanded liner section 8, in combination with the force F (if any), also can be used to provide a thrust force to the drill bit 38 during drilling of the wellbore 1. In the embodiment of FIG. 3, such thrust force is transmitted to the drill bit 38 via the guide member 28 and the support ring 26.

In an alternative embodiment, the guide member 28 is dispensed with, and axial forces are directly transmitted between the unexpanded liner section 8 and the drill string 24, or the drill bit 38, by means of a suitable bearing system (not shown).

Thus, by gradually lowering the unexpanded liner section 8 into the wellbore, the layers 12, 14 of unexpanded liner section 8 are progressively bent in an axially reverse direction thereby progressively forming the expanded liner section 10.

When it is required to retrieve the drill string 24 to surface, for example when the drill bit is to be replaced or when drilling of the wellbore 1 is completed, the support ring 26 and reamer section 42 are radially retracted. Subsequently the drill string 24 is retrieved through the unexpanded liner section 8 to surface. The guide member 28 can remain downhole. Alternatively, the guide member 28 can be made collapsible so as to allow it to be retrieved to surface in collapsed mode through the unexpanded liner section 8.

With the method described above, it is achieved that the wellbore is progressively lined with the everted liner directly above the drill bit, during the drilling process. As a result, there is only a relatively short open-hole section of the wellbore during the drilling process at all times. The advantages of such short open-hole section will be most pronounced during drilling into a hydrocarbon fluid containing layer of the earth formation. In view thereof, for many applications it will be sufficient if the process of liner eversion during drilling is applied only during drilling into the hydrocarbon fluid reservoir, while other sections of the wellbore are lined or cased in conventional manner. Alternatively, the process of liner eversion during drilling may be commenced at surface or at a selected downhole location, depending on circumstances.

In view of the short open-hole section during drilling, there is a significantly reduced risk that the wellbore fluid pressure gradient exceeds the fracture gradient of the rock formation, or that the wellbore fluid pressure gradient drops below the pore pressure gradient of the rock formation. Therefore, considerably longer intervals can be drilled at a single nominal diameter than in a conventional drilling practice whereby casings of stepwise decreasing diameter must be set at selected intervals.

Also, if the wellbore is drilled through a shale layer, such short open-hole section eliminates possible problems due to heaving of the shale.

After the wellbore 1 has been drilled to the desired depth and the drill string 24 has been removed from the wellbore, the length of unexpanded liner section 8 that is still present in the wellbore 1, can be left in the wellbore or it can be cut-off from the expanded section 10 and retrieved to surface.

In case the length of unexpanded liner section 8 is left in the wellbore 1, there are several options for completing the wellbore. These are, for example, as follows.

A) A fluid, for example brine, is pumped into the annular space between the unexpanded and expanded liner sections 8, 10 so as to pressurise the annular space and increase the collapse resistance of the expanded liner section 10. Optionally one or more holes are provided in the U-shaped lower sections 16, 20 to allow the pumped fluid to be circulated.

B) A heavy fluid is pumped into the annular space so as to support the expanded liner section 10 and increase its collapse resistance.

C) cement is pumped into the annular space to create, after hardening of the cement, a solid body between the unexpanded liner section 8 and the expanded liner section 10, whereby the cement may expand upon hardening.

D) the unexpanded liner section 8 is radially expanded against the expanded liner section 10, for example by pumping, pushing or pulling an expander (not shown) through the unexpanded liner section 8.

In the above examples, expansion of the liner is started at surface or at a downhole location. In case of an offshore wellbore whereby an offshore platform is positioned above the wellbore, at the water surface, it can be advantageous to start the expansion process at the offshore platform. In such process, the bending zone moves from the offshore platform to the seabed and from there further into the wellbore. Thus, the resulting expanded tubular element not only forms a liner in the wellbore, but also a riser extending from the offshore platform to the seabed. The need for a separate riser from is thereby obviated.

Furthermore, conduits such as electric wires or optical fibres for communication with downhole equipment can be extended in the annular space between the expanded and unexpanded sections. Such conduits can be attached to the outer surface of the tubular element before expansion thereof. Also, the expanded and unexpanded liner sections can be used as electricity conductors to transfer data and/or power downhole.

Since any length of unexpanded liner section that is still present in the wellbore after the eversion process is finalised, is subjected to less stringent loading conditions than the expanded liner section, such length of unexpanded liner section may have a smaller wall thickness, or may be of lower quality or steel grade, than the expanded liner section. For example, it may be made of pipe having a relatively low yield strength or collapse rating.

Instead of leaving a length of unexpanded liner section in the wellbore after the expansion process, the entire liner can be expanded with the method of the invention so that no unexpanded liner section remains in the wellbore. In such case, an elongate member, for example a pipe string, can be used to exert the necessary downward force F to the unexpanded liner section during the last phase of the expansion process.

In order to reduce friction forces between the unexpanded and expanded tubular sections during the expansion process described in any of the aforementioned examples, suitably a friction reducing layer, such as a Teflon layer, is applied between the unexpanded and expanded tubular sections. For example, a friction reducing coating can be applied to the outer surface of the tubular element before expansion. Such layer of friction reducing material furthermore reduces the annular clearance between the unexpanded and expanded sections, thus resulting in a reduced buckling tendency of the unexpanded section. Instead of, or in addition to, such friction reducing layer, centralizing pads and/or rollers can be applied between the unexpanded and expanded sections to reduce the friction forces and the annular clearance there-between.

Instead of expanding the expanded liner section against the wellbore wall (as described above), the expanded liner section can be expanded against the inner surface of another tubular element already present in the wellbore.

What is claimed is:

1. A method of radially expanding a tubular element extending into a wellbore formed in an earth formation, the tubular element including a first layer and a second layer extending around the first layer, said layers being separable from each other, the method comprising a) inducing each layer to bend radially outward and in an axially reverse direction so as to form an expanded tubular section extending around a remaining tubular section of the tubular element, wherein each layer has a respective bending zone in which said bending occurs; and b) increasing the length of the expanded tubular section by inducing the respective bending zones of the layers to move in an axial direction relative to the remaining tubular section;

wherein said layers in the respective bending zones are separate from each other so as to define an axial space between the layers; and wherein in the remaining tubular section, said layers are compressed against each other by virtue of a tensile hoop stress in the second layer and a compressive hoop stress in the first layer.

2. The method of claim 1 wherein at least one of said layers includes a material that is plastically deformed in the respective bending zone during the bending process so that the expanded tubular section retains an expanded shape as a result of said plastic deformation.

3. The method of claim 1 wherein said bending zones are induced to move in an axial direction relative to the remaining tubular section by inducing the remaining tubular section to move in an axial direction relative to the expanded tubular section.

4. The method of claim 3 wherein the remaining tubular section is subjected to an axially compressive force acting to induce said movement of the remaining tubular section.

5. The method of claim 4 wherein said axially compressive force is at least partly due to the weight of the remaining tubular section.

6. The method of claim 1 wherein as a result of the expansion the expanded tubular section is compressed against one of the wellbore wall and another tubular element surrounding the expanded tubular section.

7. A method of radially expanding a tubular element extending into a wellbore formed in an earth formation, the tubular element including a first layer and a second layer extending around the first layer, said layers being separable from each other, the method comprising a) inducing each layer to bend radially outward and in an axially reverse direction so as to form an expanded tubular section extending around a remaining tubular section of the tubular element, wherein each layer has a respective bending zone in which said bending occurs; and b) increasing the length of the expanded tubular section by inducing the respective bending zones of the layers to move in an axial direction relative to the remaining tubular section;

wherein said layers in the respective bending zones are separate from each other so as to define an axial space between the layers; and wherein the remaining tubular section axially shortens at a lower end thereof due to said movement of the bending zones, and wherein the method further comprises axially extending the remaining tubular section at an upper end thereof in correspondence with said axial shortening.

8. The method of claim 7 wherein as a result of step (b) the expanded tubular section is compressed against one of the wellbore wall and another tubular element surrounding the expanded tubular section.

9. The method of claim 7 wherein the second layer is provided with at least one through-opening.

10. A method of radially expanding a tubular element extending into a wellbore formed in an earth formation, the tubular element including a first layer and a second layer extending around the first layer, said layers being separable from each other, the method comprising a) inducing each layer to bend radially outward and in an axially reverse direction so as to form an expanded tubular section extending around a remaining tubular section of the tubular element, wherein each layer has a respective bending zone in which said bending occurs; and b) increasing the length of the expanded tubular section by inducing the respective bending zones of the layers to move in an axial direction relative to the remaining tubular section;

wherein said layers in the respective bending zones are separate from each other so as to define an axial space between the layers; and wherein an annular space is formed between the remaining tubular section and the expanded tubular section, the method further comprising inserting a pressurized fluid into the annular space.

11. The method of claim 10 wherein as a result of step (b) the expanded tubular section is compressed against one of the wellbore wall and another tubular element surrounding the expanded tubular section.

12. The method of claim 10 wherein the second layer is provided with at least one through-opening.

13. The method of claim 10 wherein the remaining tubular section is subjected to an axially compressive force acting to induce said movement of the remaining tubular section.

14. A method of radially expanding a tubular element extending into a wellbore formed in an earth formation, the tubular element including a first layer and a second layer extending around the first laver, said layers being separable from each other, the method comprising a) inducing each layer to bend radially outward and in an axially reverse direction so as to form an expanded tubular section extending around a remaining tubular section of the tubular element, wherein each layer has a respective bending zone in which said bending occurs; and b) increasing the length of the expanded tubular section by inducing the respective bending zones of the layers to move in an axial direction relative to the remaining tubular section;

wherein said layers in the respective bending zones are separate from each other so as to define an axial space between the layers; and wherein a drill string extends through the remaining tubular section, and wherein the drill string is operated to further drill the wellbore.

15. The method of claim 14 wherein the remaining tubular section and the drill string are simultaneously lowered through the wellbore during drilling with the drill string.

16. The method of claim 14 wherein as a result of step (b) the expanded tubular section is compressed against one of the wellbore wall and another tubular element surrounding the expanded tubular section.

17. The method of claim 14 wherein the second layer is provided with at least one through-opening.

18. The method of claim 14 wherein the remaining tubular section is subjected to an axially compressive force acting to induce said movement of the remaining tubular section.

19. A method of radially expanding a tubular element extending into a wellbore formed in an earth formation, the tubular element including a first layer and a second layer extending around the first layer, said layers being separable from each other, the method comprising a) inducing each layer to bend radially outward and in an axially reverse direction so as to form an expanded tubular section extending around a remaining tubular section of the tubular element, wherein each layer has a respective bending zone in which said bending occurs; and b) increasing the length of the expanded tubular section by inducing the respective bending zones of the layers to move in an axial direction relative to the remaining tubular section;

wherein said layers in the respective bending zones are separate from each other so as to define an axial space between the layers; and wherein the second layer is provided with at least one through-opening.

* * * * *